United States Patent [19]

Armstrong

[11] Patent Number: 4,757,738

[45] Date of Patent: Jul. 19, 1988

[54] WATER KEY FOR BRASS MUSICAL INSTRUMENTS

[76] Inventor: Joseph B. Armstrong, 2113 Brookview Dr., Nashville, Tenn. 37214

[21] Appl. No.: 76,848

[22] Filed: Jul. 23, 1987

[51] Int. Cl.[4] ..... G10D 7/10

[52] U.S. Cl. ..... 84/397

[58] Field of Search ..... 84/382, 397

[56] References Cited

U.S. PATENT DOCUMENTS

| | | | |
|---|---|---|---|
| 885,880 | 4/1908 | Stahl | 84/382 |
| 1,083,620 | 1/1914 | Krause | 84/395 |
| 1,646,059 | 10/1927 | Hebs et al. | 84/397 |
| 3,504,590 | 4/1970 | Bedford | 84/380 R |
| 3,782,236 | 1/1974 | Shalek et al. | 84/397 |

*Primary Examiner*—Lawrence R. Franklin

*Attorney, Agent, or Firm*—Trabue, Sturdivant & DeWitt

[57] ABSTRACT

A mechanism comprising a torsionally biased control rod having a valve cap which presses tightly against the valve opening found in the tubing of brass musical instruments. The control rod runs adjacent and parallel to the tubing of the instrument and may be adjusted to any length. The control rod's proximate end has a thinner diameter than its distal end. The proximate end of the control rod and passes through a ferrule which is affixed to the instrument tubing. The control rod's distal end is too wide to pass though the ferrule. A cap having a finger push pad is secured to the proximate section of control rod which extends from the ferrule. The cap diameter exceeds the ferrule diameter. The cap contains a spring which applies rotational bias to the control rod so that the valve cap normally presses against and seals the valve opening. When the push pad is depressed, however, the control rod rotates in a direction opposing its spring bias and the valve cap rises from the valve opening. When the finger pad is released the control rod rotates in the direction of its spring bias, and the valve cap returns to its original position as a seal to the valve opening.

12 Claims, 1 Drawing Sheet

WATER KEY FOR BRASS MUSICAL INSTRUMENTS

BACKGROUND OF THE INVENTION

The present invention relates to a water key for brass musical instruments, particularly slide trombones.

The purpose of a musical instrument water key is to provide an orifice through which condensation and moisture can be expelled. In the past, water keys have been constructed in a variety of fashions, but all suffer certain limitations. Trumpet style water keys, for instance, consist of valve caps attached to levers on springed fulcrums. These are difficult to manufacture in varying sizes or lengths; they must often be manufactured from costly casted parts; and they are awkward to assemble and easily caught on objects or damaged. Other specialized trombone water keys, see, e.g., Williams, U.S. Pat. No. 2,439,997 (1948), in addition to suffering similar constraints, require lubricants and deteriorate with usage. Finally, the Amado piston style water key also is unsuitable in many applications: it provides only a small orifice for water drainage; it is relatively heavy; and its piston is generally confined to small dimensions which make it unsuitable for reaching over long distances as required, for example, on a trombone slide.

The primary object of this invention is to provide a water key with few individual parts which can be easily manufactured and installed. It is also intended to replace typical water keys comprised of bent or cast parts, or parts which will stick due to lack of lubrication or wear.

Another object of this invention is to provide a water key that is operated comfortably by the natural action of the musician's fingers.

Another object of the invention is to provide a water key that closely fits the contour of the instrument so as to eliminate the inconvenience and damage resulting from a musician's accidentally striking the water key or catching it on another object.

Still another object of this invention is to provide a water key that shortens the distance a musician needs to reach in order to effect its operation.

Still another object of this invention is to provide a water key that can be easily adapted to left-handed or right-handed musicians.

With the foregoing objects in view, as may appear hereinafter, reference is directed to the accompanying drawings.

SUMMARY OF THE INVENTION

The present invention is a water key comprising the following general components:

(1) a control rod with a valve cap attached at one end;

(2) a ferrule assembly consisting of a concentrically bored rod joined longitudinally to the exterior of a sleeve joint;

(3) a push element assembly consisting of a push cap and finger pad;

(4) a torsion spring means.

The control rod runs adjacent and parallel to the tubing of a musical instrument. A valve cap is attached to the side of the control rod at the distal end, and at approximately 45° to the control rod's circumference so that, when rotated about its axis, the control rod sets the valve cap tightly over the instrument's valve opening. Water and condensation normally collect over this opening. Thus, by rotating the control rod away from the opening, water can be expelled from the instrument.

The control rod is slid through the ferrule assembly and thereby engaged with the instrument. The proximate section of the control rod has a diameter smaller than the distal section. In consequence, the proximate section of the control rod is able to slide through a stem sleeve forming part of the ferrule assembly; but the distal section is not. The stem sleeve is affixed longitudinally to the lower sleeve joint which precedes a U-shape bend in the instrument tubing.

The proximate section of control rod is longer than the ferrule assembly's stem sleeve. Therefore, a portion of the control rod will always extend outside the stem sleeve. A push element cap with a torsional spring and finger pad is secured to this surplus control rod by means of an adjustable screw which runs through the cap and pad. The push element cap has a diameter wider than the inside diameter of the stem sleeve. Therefore, the control rod is unable to move longitudinally in either distal or proximate directions: it may only be rotated.

The torsional spring applies rotational bias to the control rod so that the valve cap is normally pressed firmly over the instrument's valve opening. A hermetic seal is formed. However, the musician may temporarily rotate the control rod by depressing the finger pad attached to the side of the push element cap. As the control rod rotates, the valve cap will temporarily rise off the valve opening and water may be blown out of the instrument. When the musician releases his finger the torsional spring means forces the control rod to rotate in the opposite direction until the valve cap once again presses against the valve opening and further rotation ceases.

DETAILED DESCRIPTION OF THE INVENTION

This invention relates to a water key which may be affixed to the tubing of a number of wind instruments. When depressed the water key creates a temporary opening through which moisture and condensation can be expelled. However, in its normally undepressed condition the spring biased water key closes the opening with an airtight seal so as not to impair the sound quality of the musical instrument. The invention incorporates rugged, durable and inexpensive machined part construction; its component parts may be easily assembled, installed and serviced. The invention is especially useful when applied to trombone slides: it is unobtrusive, running parallel and attached to the tubing so as not to catch on other objects and sustain damage, and it can be simply lengthened to accommodate any musician's reach.

Figure 1:
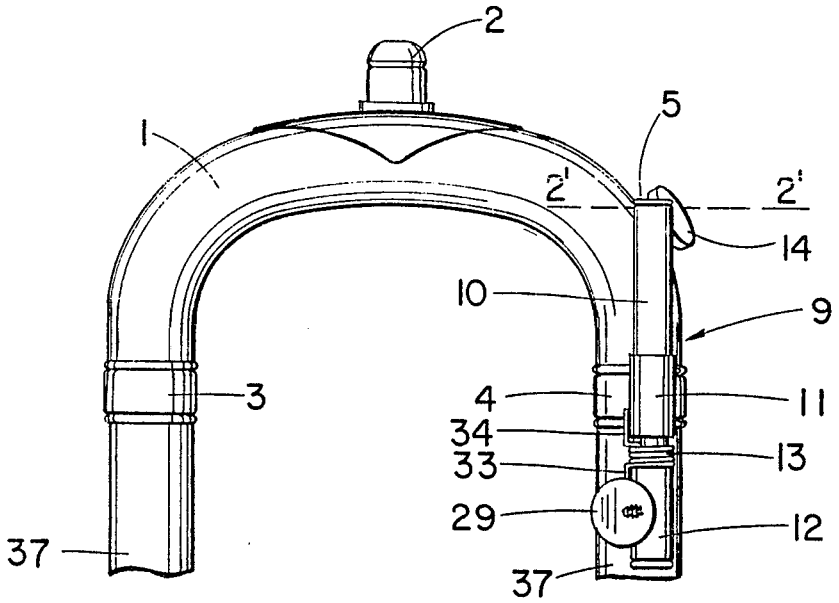
FIG. 1 is a fragmentary isometric view of the U-tube assembly on the end of a trombone incorporating the present invention.
Figure 2:
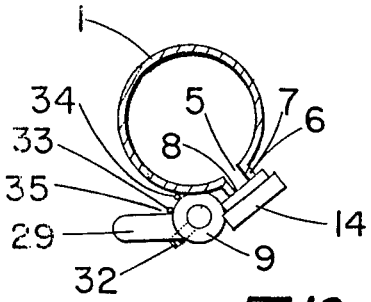
FIG. 2 is a fragmentary side view of FIG. 1 taken distally along the line 2'—2'.

Referring now in more detail to the drawings: FIGS. 1 and 2 show the invention installed in combination with a U-shaped tube 1 commonly found in the distal end of a trombone slide (not shown). As well known from prior art, the U-shaped tube 1 is reinforced and protected from damage by means of a rest and guard 2. And each end of the U-shaped tube 1 is fitted with upper and lower sleeve joints 3 and 4 respectively, that connect with parallel tubes 37 (shown in fragment) of the slide.

An opening 5 is shown at the lowest point on the slide where moisture and condensation collect while the instrument is played. The diameter of the opening 5 should be at least 3/16"; it should also be disposed and angled to the right (i.e. away from the trombone bell) of the bottom of the U-shaped tube 1 (approximately 25° from the centerline of the lower parallel tube), as in normal usage the trombone slide is slightly angled in this direction by the player. An outwardly directed tubular washer 6 surrounds the opening 5 and together with its reinforcement 7, forms a valve seat 8.

My water key 9 permits the selective opening and closing of opening 5. It consists essentially of four component parts: to wit, a control rod assembly 10; a ferrule assembly 11 which incorporates the lower sleeve joint 4 and through which part of the control rod assembly 10 passes; a stem cap assembly 12; and a torsional spring 13. In order to understand the invention's proper operation each component part must first be examined in isolation.

Figure 3:
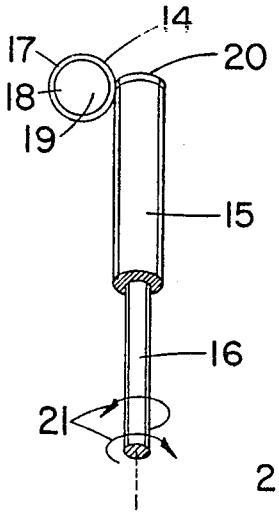
FIG. 3 is an isometric view of the control rod assembly.
Figure 4:
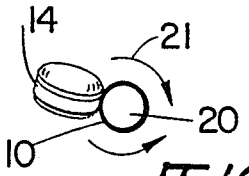
FIG. 4 is a top plan view of the central rod assembly.

FIGS. 3 and 4 detail the construction of the control rod assembly 10 which comprises an angled valve element 14 soldered to a protruding stem 15 which in turn connects to an inside stem 16. In the water key's undepressed condition the angled valve element 14 provides the selective seal to opening 5. This angled valve element 14 comprises a brass valve cap 17 having a recess 18 which receives a washer 19 of cork, neoprene, rubber or similarly pliant material acting in registry with the valve seat 8 to form an airtight seal.

The angled valve element 14 is soldered or otherwise attached to the distal portion of the protruding stem 15 at an angle equal to the tangent or gradient of the U-shaped tube 3 at opening 5. This ensures that the washer 19 will make a secure airtight contact with the valve seat 8. The protruding stem 15 is beveled at its distal end 20 with an ornamental design. However, the majority of the protruding stem is constructed from solid round brass rod which is durable and easily soldered to, yet aesthetically pleasing. It is also easily machined, and it can be electroplated with other metals for lubricity. Running concentrically with the protruding stem 15 is a tubular inside stem 16 milled from the same metal section as the protruding stem 15. The inside stem 16 engages with the ferrule assembly 11 and stem cap assembly 12 so that the water key 9 is held firmly and closely to the musical instrument and has movement only about its direction of rotation 21.

Figure 5:
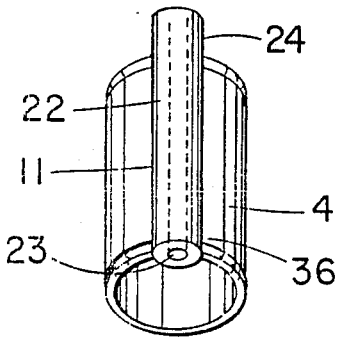
FIG. 5 is an isometric view of the ferrule assembly.
Figure 6:
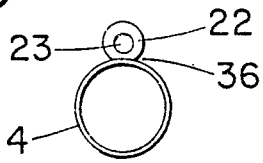
FIG. 6 is a top plan view of the ferrule assembly.

FIGS. 5 and 6 show the ferrule assembly 11 consisting of the lower sleeve joint 4 attached to a stem sleeve 22. This provides the anchor and support means for the control rod assembly 10. Stem sleeve 22 comprises a brass rod with flat ends through which a longitudinally running concentric bore 23 is drilled. The concentric bore 23 has a diameter approximately 3/1000" wider than the inside stem 16 of the control rod assembly 10. And the stem sleeve diameter is approximately 1/32" wider than the diameter of the protruding stem 15 of the control rod assembly 10. By ensuring that the stem sleeve diameter is slightly wider than the protruding stem diameter, there is no risk that the protruding stem 15 will rub against or be obstructed by the instrument's U-shaped tube. Additionally, limiting width dimensions of all components is obviously a good practice as it helps reduce the overall weight of the water key 9.

Stem sleeve 22 is typically joined to the lower sleeve joint 4 by means of silver brazed solder thereby forming a permanent ferrule assembly 11. To facilitate assembly and proper alignment of the stem sleeve 22 and lower sleeve joint 4 it is a good practice to grind flat longitudinally running strips (e.g. ⅛" wide) along each piece. Other bounding and alignment methods for longitudinally connected cylindrical tubes are well known in the prior art. It also is important that the stem sleeve 22 be milled to a longitudinal length of approximately 1/16" greater than the lower sleeve joint 4. This will prevent the silver braze from flowing into the top or bottom of the stem sleeve 22 and thereby impairing the operation of the water key 9. After these steps are taken, it is simple to incorporate the ferrule assembly 11 into an existing trombone or other brass instrument by simply interchanging a conventional sleeve joint with the ferrule assembly 11.

When the water key 9 is assembled, the inside stem 16 of control rod 10 passes through the concentric bore 23 so that the protruding stem 15 presses flush against the top or distal end of the stem sleeve 22. This checks further movement of the control rod assembly 10 in the proximate direction (i.e. away from the U-shaped tube 1). But although the control rod is connected to the trombone (or other brass instrument) by means of the ferrule assembly 11 it should be noted that the control rod assembly 10 still remains free to rotate about its axis 21.

The stem sleeve 22 must have a length less than the inside stem 16 length. In the preferred embodiment, the stem sleeve 22 is approximately 9/16" in length and has a concentric bore 23 with a diameter slightly greater than ⅛" (e.g. ⅛"+3/1000); the stem sleeve outside diameter is approximately 9/32" (i.e. slightly wider than the protruding stem diameter). The inside stem, in contrast, has a diameter of ⅛" and a length of approximately 1½" (e.g. long enough to exceed the stem sleeve length). The protruding stem 15 has a length of approximately 1" (i.e. a length sufficient for the valve element 14 to reach opening 5), and a diameter of approximately ¼". Notwithstanding, these specific dimensions may be significantly altered without departing from the spirit of the invention. The water key may be altered simply by lengthening the protruding stem 15 or the inside stem 16; this allows custom tailoring of the invention to suit the dimensions of the instrument or the arm or hand reach of the musician.

Regardless of the specific dimensions chosen for the control rod assembly 10 and ferrule assembly 11, the inside stem 16 should extend proximately (i.e. away from the U-shaped tube 1) through and outside of the stem sleeve at 24. Typically, this surplus extension is between ⅜" to 1" in length.

Figure 7:
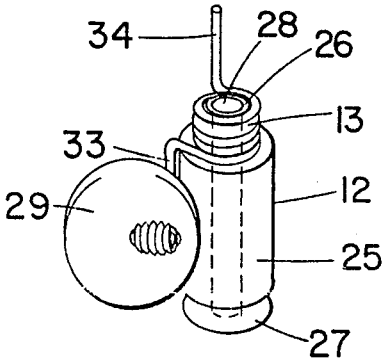
FIG. 7 is an isometric view of the stem cap assembly and torsional spring.
Figure 8:
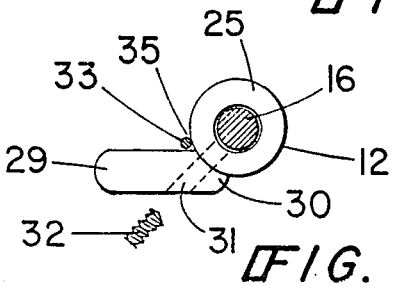
FIG. 8 is a top plan view of the stem cap assembly.

With respect to FIGS. 7 and 8, a stem cap assembly 12 is shown superposed concentrically on surplus extension of the inside stem 16. The stem cap assembly 12 comprises a brass stem cap 25 having a collar 26, approximately ⅛" in length, at its distal end and a decorative or beveled portion 27 at its proxiamte end. A concentric bore 28 having a diameter slightly greater than the inside stem diameter (e.g. 3/1000" greater) runs longitudinally through the stem cap assembly 12 and terminates at the beveled cover 27. A push element 29 is attached, in an angled fashion, to the stem cap.

One end of the push element 30 is milled to conform to the radius of curvature of the stem cap 25 for easy solder connection. Also a threaded bore 31 is directed radially inward into the stem cap 25, through the push element 30, and screw 32 is inserted. When tightened, screw 32 secures the stem cap assembly 12 to the proximate end of the inside stem 16 so that the inside stem 16 is completely concealed, and the collar 26 is flush against the proximate end 24 of the stem sleeve 22. With the stem cap assembly 12 thus attached, the control rod assembly 10 is now prevented from moving in the distal direction as well as the proximate direction.

A torsional spring 13 with upper and lower arms, 33 and 34 respectively, concentrically superposes the collar 26. The upper arm 33 is positioned in the acute angle 35 formed between the push element 29 and the stem cap while the lower arm 34 is placed in the groove 36 that results between sleeve joint 4 and stem sleeve 22. When screw 32 is tightened the torsional spring 13 should be under sufficient force to maintain arms 33 and 34 in place. The pressure exerted by the torsional spring 13 ultimately rotates the control rod 10 until the valve element 14 is forced into the valve seat 8. Obviously, other spring means—such as needle or clock springs—can be used as substitutes. I have found, however, that the torsional spring is more durable, inexpensive and easy to assemble.

As assembled, the water key operates as follows: The musician pushes the push element 29 down with his finger. Since the push element 29 and stem cap assembly 12 are engaged with the control rod assembly 10 by means of screw 32, the control rod assembly rotates about its axis, and the valve element 14 is lifted off the valve seat 8. Water thereby drains from the U-shaped tube 1 at opening 5. While this occurs, however, the torsional spring 13 is under considerable tension. Thus, when the musician releases his finger the control rod assembly 10 rotates about its axis in the opposite direction so that the valve element is returned to its former position. The valve element 14 again exerts pressure over valve seat 8 and, consequently, an airtight seal is created over opening 5.

It will be appreciated that the component parts of this invention are symmetrical (i.e. cylindrical) along a longitudinal axis, and are easy to manufacture to good tolerances. Therefore it is possible to use the component parts for water keys designated for both right-handed and left handed-players, simply by changing the side of the instrument tubing on which they are installed.

The water key 9, as described above, is a preferred embodiment used in trombone applications. It is obviously possible under this embodiment, by lengthening the protruding stem 15 or the stem sleeve 22, to operate the water key while the instrument bell is projected horizontally, as in normal usage. The musician's arm will easily reach the water key regardless of the way the instrument is held. Under these circumstances the tube opening 5 should be moved proximately in order to drain water which collects at the lowest position of the U-shaped tube while the instrument is in its playing position. I have found this lowest point exists at a position approximately 25 degrees away from the centerline of the parallel slide tubes (i.e. away from the instrument bell) and 25 degrees from the perpendicular of the centerline of the parallel slide tubes.

The particular embodiment of the invention has been described in detail herein for purposes of illustration. I have described, for instance, manufacturing the invention out of milled brass parts, as brass parts are generally easy to solder, assemble and dismantle. Additionally, brass has lubricity, rigidity and the ability to receive electroplating. Nonetheless, other lightweight materials—lightweight metals, plastics, carbon fiber, etc.—may be used as a replacement for brass. It will be appreciated by those of ordinary skill in the art that other modifications may be made without departing from the spirit and scope of the invention. Accordingly, the invention is not to be limited except as by the appended claims.

I claim:

1. A water key for brass musical instruments, comprising: a control rod with distal and proximate ends, a valve element at said distal end, and a protuberance between said ends; a ferrule means through which said proximate end may pass but not said protuberance; a push element affixed to said proximate end; a torsional spring means concentric with and superposed over said proximate end, said spring means applying torsional bias to said control rod; and said ferrule means secured in conformity with a tube forming part of a musical instrument with said torsional spring means forcing said valve element in registry with a valve opening in said tube.

2. The water key for brass musical instruments as defined in claim 1 wherein said control rod has no protuberance but rather comprises two solid, continuous and concentric sections of a metal rod, the first distal section of said metal rod having a diameter exceeding the second proximate section of said metal rod; wherein said second proximate section may pass through said ferrule means but not said first distal section.

3. The water key for brass musical instruments as defined in claim 1 wherein said push element comprises a pad which may be depressed by the musician's finger, which pad is further affixed longitudinally and radially outward to a cylindrical housing means having a concentric bore of sufficient diameter to contain and secure the portion of said proximate end of said control rod which has passed through said ferrule means.

4. The water key for brass musical instruments as defined in claim 1 wherein said ferrule means comprises a cylindrical rod with a coaxial bore of sufficient diameter to allow passage of said proximate end of said control rod up to said protrusion, said cylindrical rod being at least one ⅛" shorter longitudinally than said proximate end of said control rod up to said protuberance; and a sleeve joint joined longitudinally to said cylindrical rod; wherein said sleeve joint may be secured in conformity with a tube forming part of a musical instrument, such as a trombone, prior to said tube forming a U-shaped bend.

5. The water key for brass musical instruments as defined in claim 1 wherein said components are constructed from machine tooled brass.

6. The water key for brass musical instruments as defined in claim 1 wherein said spring means comprises a coiled metallic torsional spring having a straight upper arm extending from one end and a straight lower arm projecting off the other end, wherein both said upper and lower arms run parallel to each other, and to said spring's axis of rotation; and wherein said upper arm engages with said push element and said lower arm engages longitudinally with said ferrule means where said ferrule means joins said tubing of said musical instrument.

7. The water key for brass musical instruments as defined in claim 1 wherein said push element comprises a round pad which may be depressed by the musician's finger, which pad is further affixed longitudinally and at an angle to the radial axis of a cylindrical housing means having a longitudinally directed concentric bore capable of receiving said proximate end of said control rod; said round pad incorporating a threaded bore directed radially inwards to said cylindrical housing means into which a screw may be inserted for locking said push element to said control rod; and wherein said cylindrical housing has a collar at least ⅛" in length at said cylindrical housing's distal end over which said spring means may be coaxially superposed between said cylindrical housing and said ferrule means.

8. The combination with a musical instrument having a metal or wooden tube and valve opening in the wall of said tube, of a water key for said opening, comprising: a control rod with distal and proximate ends, a valve element at said distal end, and a protuberance between said ends; a ferrule means through which said proximate end may pass coaxially but not said protuberance; a push element affixed to said proximate end; and a torsional spring means concentric with and superposed to said proximate end, in which said spring means applies torsional bias to said control rod.

9. The combination as described in claim 8 wherein said valve element is angled with respect to said control rod for optimum contact with said valve opening; and wherein said valve opening is displaced between 20 and 30 degrees away from the centerline axis of said tube and between 20 to 30 degrees from the perpendicular of the centerline of said tube; and wherein said valve opening is at least 3/16" in diameter.

10. The water key for brass musical instruments as defined in claim 1 wherein said push element comprises a round pad which may be depressed by the musician's finger, which pad is further affixed longitudinally and at an angle to the radial axis of a cylindrical housing means having a longitudinally directed concentric bore capable of receiving said proximate end of said control rod; said round pad incorporating a threaded bore directed radially inwards to said cylindrical housing means into which a screw may be inserted for locking said push element to said control rod; and wherein said cylindrical housing has a groove in which said spring means may be secured coaxially to said cylindrical housing.

11. The water key for brass musical instruments as defined in claim 1 wherein said spring means comprises a needle spring.

12. The water key for brass musical instruments as defined in claim 1 wherein said spring comprises a clock or diaphragm style spring.

* * * * *